US006588175B1

(12) United States Patent
Gaudenzi

(10) Patent No.: US 6,588,175 B1
(45) Date of Patent: Jul. 8, 2003

(54) DEVICE FOR FOLDING FLAPS OF BOX-LIKE CONTAINERS

(75) Inventor: Rodolfo Gaudenzi, Bologna (IT)

(73) Assignee: I.M.A. Industria Macchine Automatiche S.p.A., Bologna (IT)

( * ) Notice: Subject to any disclaimer, the term of this patent is extended or adjusted under 35 U.S.C. 154(b) by 0 days.

(21) Appl. No.: 10/031,725

(22) PCT Filed: Jul. 19, 2000

(86) PCT No.: PCT/IB00/01000

§ 371 (c)(1),
(2), (4) Date: Apr. 2, 2002

(87) PCT Pub. No.: WO01/05660

PCT Pub. Date: Jan. 25, 2001

(30) Foreign Application Priority Data

Jul. 20, 1999 (IT) ..... B099A0409

(51) Int. Cl.[7] ..... B65B 7/20

(52) U.S. Cl. ..... 53/378.3; 53/376.4; 53/376.7; 53/377.2; 493/405; 493/397; 493/440

(58) Field of Search ..... 53/566, 376.2, 53/376.4, 377.2; 493/397, 405, 446, 438, 431, 440

(56) References Cited

U.S. PATENT DOCUMENTS

| | | | | |
|---|---|---|---|---|
| 2,380,758 A | | 7/1945 | Hohl | |
| 4,159,610 A | * | 7/1979 | Langen | 53/525 |
| 4,505,694 A | * | 3/1985 | Okushita | 493/101 |
| 4,805,375 A | * | 2/1989 | Langen et al. | 53/142 |
| 4,871,070 A | * | 10/1989 | Langen et al. | 206/591 |
| 5,106,359 A | * | 4/1992 | Lott | 493/125 |
| 5,393,291 A | * | 2/1995 | Wingerter | 493/116 |
| 5,595,043 A | * | 1/1997 | Radigan | 53/201 |
| 6,226,965 B1 | * | 5/2001 | Lam | 53/491 |
| 6,385,945 B1 | * | 5/2002 | Hahnel | 53/377.2 |

FOREIGN PATENT DOCUMENTS

| | | |
|---|---|---|
| GB | 858909 | 1/1961 |
| JP | 02045304 | 2/1990 |

* cited by examiner

*Primary Examiner*—Rinaldi I. Rada
*Assistant Examiner*—Hemant M. Desai
(74) *Attorney, Agent, or Firm*—William J. Sapone; Coleman Sudol Sapone, P.C.

(57) ABSTRACT

A device for folding vertical flaps of a container (1) moved along a line (100) for packaging products (3) into these containers (1) includes a (cam) member (11), guided along a cyclical trajectory (T) by support and operating means (20) cooperating with trajectory correcting means (6). The trajectory (T) includes a first part (T1), along which the (cam) member (11) moves close to container (1), upstream of said rear vertical flap (5) with respect to the container (1) movement direction (W), and a second part (T2), along which the rear vertical flap (5) is pushed. The second part (T2) is substantially parallel to the direction (W) and concordant therewith. The supporting and operating means (20) include a pulley (21) and a connecting rod (22), aimed at guiding the (cam) member (11) and a bar (13), connected thereto, along a circumference arc. The trajectory correcting means (6) include a rotating body (31), aimed at receiving slildingly the bar (13) in a seat (32) made therein.

5 Claims, 4 Drawing Sheets

W
1
4
5
6
7
7a
11
11a
11b
11c
10
12
13
20
21
22
30
31
32
A1
A2
C
T
T1
T2
TA
P1
P2
Xa 80
81
81a
82a
82b
82
83
84
21,61
22,62
W1
Xb
Xa

DEVICE FOR FOLDING FLAPS OF BOX-LIKE CONTAINERS

TECHNICAL FIELD

The present invention relates to automatic packaging machines. In particular, the present invention concerns a device, which is joined to a machine for packaging products in related box-like containers, and which is capable of folding vertical flaps of the containers during the container closure steps.

BACKGROUND OF THE INVENTION

It is known that machines for packaging products in box-like containers withdraw cyclically a flat folded tubular blank from a suitable magazine and erect it, so that it becomes a container. Then these machines place the obtained container on a packaging line, which moves step-wise horizontally and in a determined direction, with a predefined rate.

On a parallel way, the products to be packaged, usually already pre-packaged in blister packs, vials or others, are carried to a working station, in step relation with the forward motion of the boxing line. Then the products are introduced into related containers by pusher means.

In this step, a typical container is opened at both ends, which are situated on opposite sides with respect to the above mentioned forward motion direction.

Each of the apertures formed by the open ends features a pair of vertical flaps, later on called fore flap and rear flap with respect to the above mentioned forward motion direction, and a horizontal flap.

After having been folded, these flaps define the container opposite head walls.

Usually, in order to facilitate the introduction of the products into the container, the latter is situated on the packaging line in such a way that the horizontal flap of the introduction aperture extends from the upper aperture edge.

Generally, the container flaps are closed according to a predetermined sequence by suitable devices, which gradually fold the flaps and bring them close to the container body.

In particular, the flaps of the aperture opposite to the products introduction one are closed upstream of the products introduction station, while the flaps of the products introduction aperture are closed downstream of the above mentioned forward motion direction.

Various known devices have been used so far for closing the vertical flaps.

According to the operation steps of some devices, the fore flap of the container, while moving, strikes a stationary stop, which folds the fore flap and keeps it in the folded position, against the flap tendency to return to its original position due to the elastic reaction, until another closing member, of known type, folds also the horizontal flap.

The rear flap is closed by a hinged protruding arm, which folds the rear flap before it reaches the stationary stop and keeps it in the folded position until the outer edge of the rear flap is taken under control by the stop.

The above described solution is relatively simple, but it is not very convenient when the container size must be changed. Actually, in this case, the hinged arm must be moved towards upstream, or downstream, in a very precise way, according to the flap size change.

Also the hinged arm size must be changed according to the flap size change.

Moreover, the vertical position of the arm must be set taking into consideration not only the vertical flap width, but also the possible presence of the horizontal flap journaled to the aperture upper edge.

Another know device for closing vertical rear flaps includes a disc, situated beside the packaging line and featuring a suitably shaped cavity.

The disc is driven into rotation in step relation with the container movement, so that the flap enters the above mentioned cavity.

At this point, the cavity edge folds the flap. The above described device folds correctly flaps of different width. However, in case of size changeover, the device must be positioned at different distances from the stationary stop accordingly. Moreover, the device vertical position must be changed in relation to the different heights of the flaps of containers of different size, as well as in relation to possible presence of the horizontal flap hinged to the container upper wall.

Another closing device includes a plurality of discs, situated one over another. However, this device does not solve the problem due to the every-time-different distance from the stationary stop and to the presence of the horizontal flap hinged to the container upper wall.

Another drawback of known folding devices results from the way in which they act on the flaps, rather jerky, sharp movements, which can sometimes damage the flaps.

From documents "PATENT ABSTRACTS OF JAPAN, vol. 014 no. 209 (M-0968), Apr. 27, 1990 & JP-A-02 045304 (MITSUBISHI HEAVY IND LTD)" a device is known which folds side flaps of boxes being filled. To omit an adjustment work of a side flap tucker every size-change, an end of a L-like stacker body, forming a flap pusher, is supported slidably with a link and is connected, at a middle part, to a circulating lever. When le lever rotates, the joining point between the stacker and the link reciprocates over a circumference arc and the flap pusher at the front of the stacker follows the box movement for a short time while folding the flap. When the flap length is altered, the flap tucker is not to be adjusted like in conventional cases.

SUMMARY OF THE INVENTION

The object of the present invention is to propose a device for closing vertical flaps of a container, e.g. a box-like container, moved along a packaging line, a device which does not present the above mentioned drawbacks and can work with containers of different size, equipped with different flaps.

Another object of the present invention is to propose a device, which can be used also with containers having horizontal flaps situated in the lower wall, independently from the container size.

A further object of the present invention is to propose a device which is able to fold the rear flaps with a gradual movement, preventing the container from stresses and pushes, thus without leaving traces of the folding operation.

Still another object of the present invention is to propose a simple and strong device, which is completely reliable and does not provoke or sustain damages even in case of loss of working synchronism.

The above mentioned objects are obtained, in a device for folding vertical flaps of box-like containers being moved in a forward direction along a line for packaging products into the containers, with each container including at least one fore vertical flap and at least one rear vertical flap, which are to be folded toward the inside of a corresponding aperture of the container, so as to define respective head walls of the container, including:

at least one stationary striker situated beside said packaging line and in a path of said aperture, for intercepting said fore vertical flap while said container is moving and for folding said fore flap toward the inside of said aperture;

folding means for folding said rear vertical flap, situated upstream of said stationary striker with respect to said forward direction, said folding means moving cyclically along a trajectory including at least one first part, in which said folding means move close to said container, and at least one second part, in which said folding means touch said rear flap and fold it toward inside of said aperture, said first part being substantially perpendicular to said forward direction, upstream of said rear flap, and said second part being substantially parallel to said forward direction an concordant therewith;

supporting and operating means for supporting and guiding said folding means along a circumference arc concentric with a first axis;

trajectory correcting means guided by said folding means for constraining said folding means while rotating about a second axis, said second axis being substantially parallel to said first axis, with a combination of a shift and rotation movements causing said folding means follow said trajectory;

transmission means, aimed at moving said operating means in step relation with the packaging line forward movement.

BRIEF DESCRIPTION OF THE DRAWINGS

The characteristic features of the invention, not evident from what has just been said, will be pointed out in the following description considered along with the enclosed drawings, in which.

BEST MODES OF CARRYING OUT THE INVENTION

Figure 1:
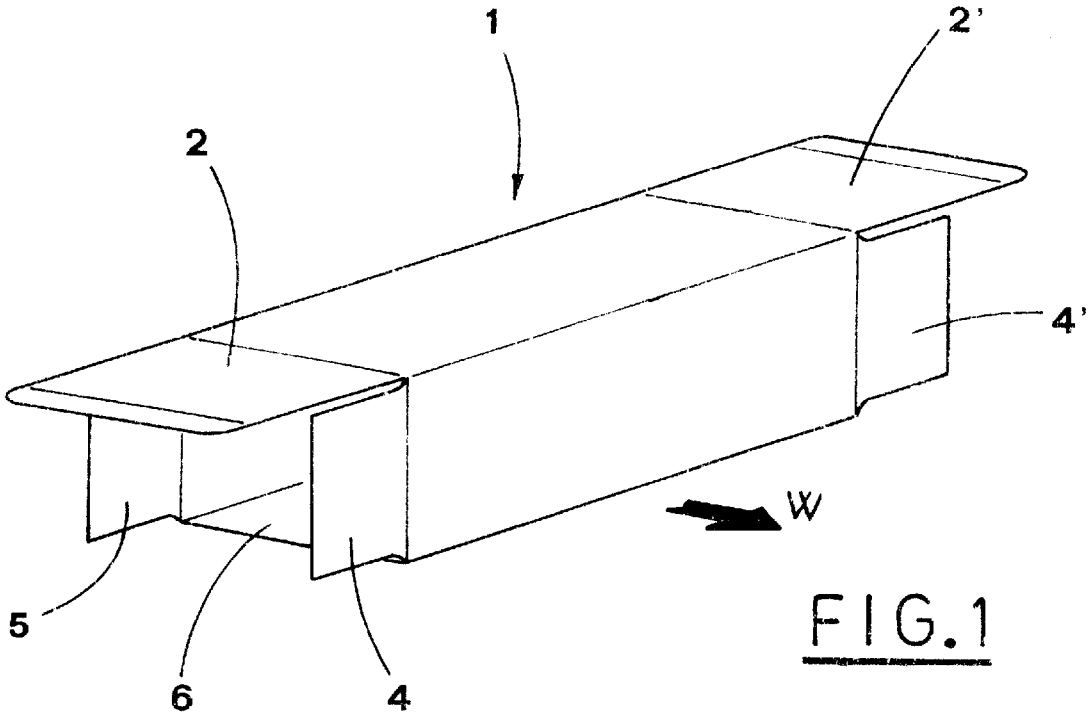
FIG. 1 shows a box-like container of known type equipped with horizontal flaps extending from the same panel.

With reference to FIGS. from 1 to 4, the reference numeral 1 indicates a box-like container, which is situated on a conveyor 101 of a packaging line 100 of known type. The conveyor moves in a direction W.

The container 1 is to be filled with a product 3.

The container 1 is obtained, in accordance with a known technique, from a tubular blank, or sleeve, and features at both ends an aperture 6, 6'.

A horizontal flap 2 and vertical flaps, namely a fore flap 4 and a rear flap 5, extend from the edges of the apertures 6, 6'. The flaps are aimed at being folded to form the container bottom walls.

In particular, the horizontal flaps 2 can extend from the same lateral wall of the container 1 (see FIG. 1).

The container 1 is situated on the conveyor 101 in such a way that its lateral wall without horizontal flaps lies on the operative run of the conveyor.

Figure 2:
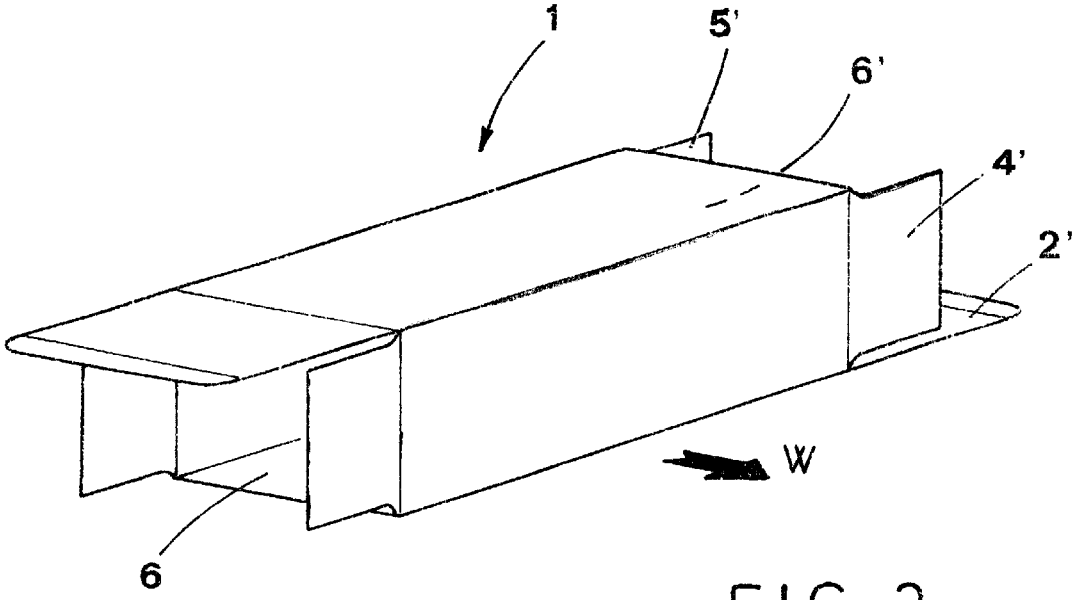
FIG. 2 shows another known container equipped with horizontal flaps extending from opposite panels.
Figure 3:
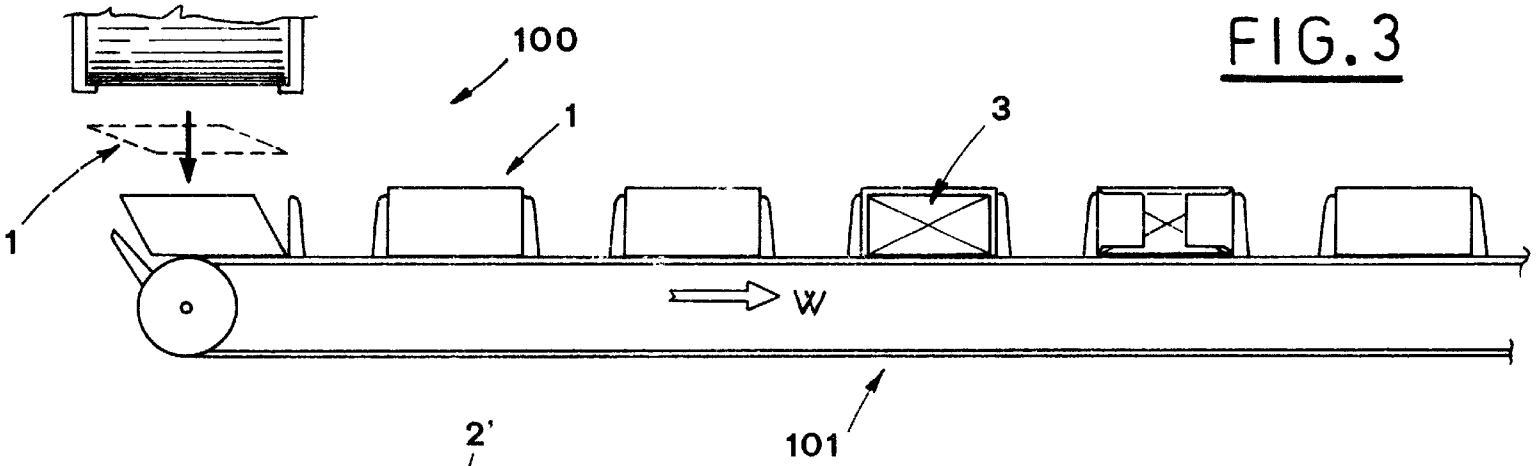
FIG. 3 is a schematic lateral view of a packaging line, showing the steps in which a container is erected; filled and closed.
Figure 4:
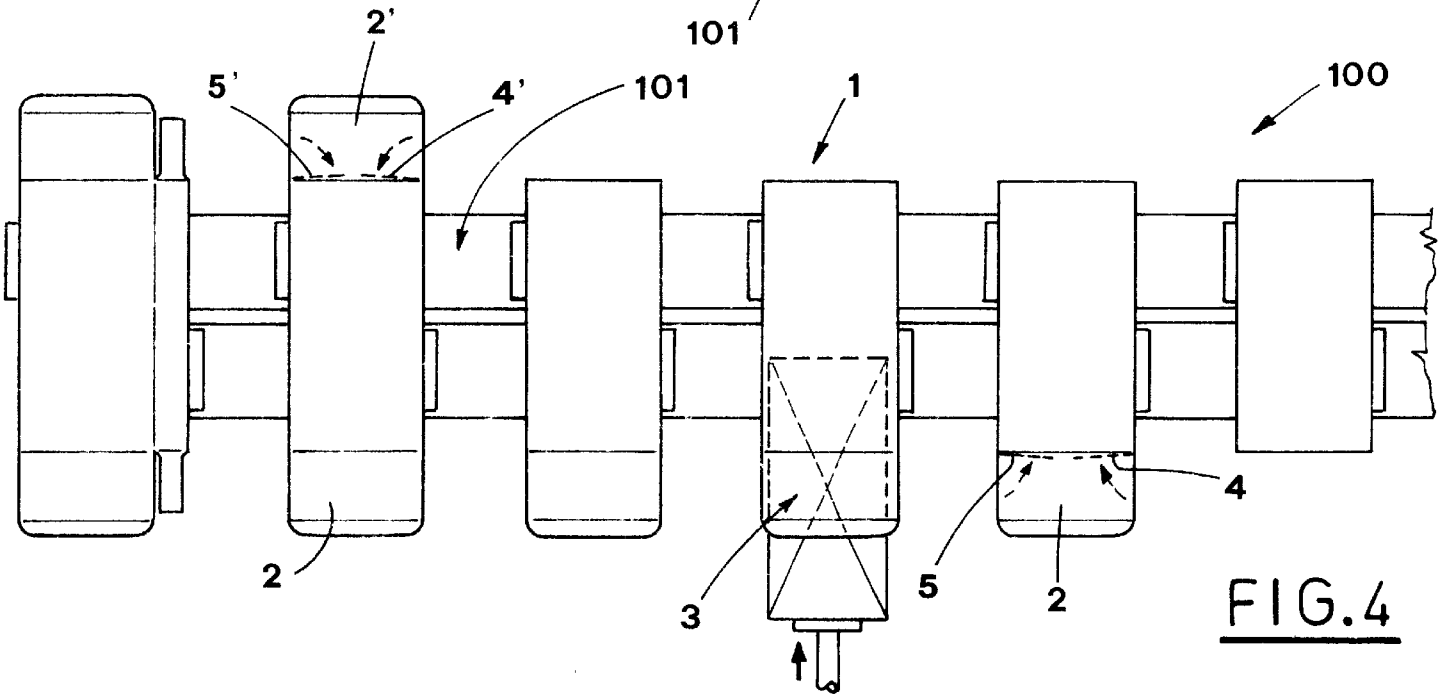
FIG. 4 is a schematic top view of the packaging line of FIG. 3.

If the horizontal flaps extend from the opposite lateral walls (see FIG. 2), a horizontal flap 2', usually the one situated on the end opposite to the product 3 introduction end, extends from the lateral wall lying on the conveyor 101. The vertical flaps, fore 4' and rear 5', corresponding to this last mentioned horizontal flap 2' are situated over the same horizontal flap 2'.

According to the shown embodiment, the device for folding the vertical flaps 4, 5 (see FIGS. 5*a* to 5*c*), particularly appropriate to be used when the flaps extend from the same wall, includes a stationary striker 7, situated beside the packaging line 100 and parallel thereto, in the path along which the aperture 6 moves.

The striker 7 is aimed at intercepting the fore vertical flap 4 while the container 1 moves in direction W, so as to fold it toward the inside of the aperture 6.

The terminal part 7*a* of the striker 7 is tapered on the side turned toward the aperture 6, so as to facilitate the fore flap 4 folding.

Folding means 10 for folding the rear vertical flap 5 are situated downstream of the stationary striker with respect to the movement direction W.

Figures 5A, 5B, 5C, 5D, 5E, 5F:
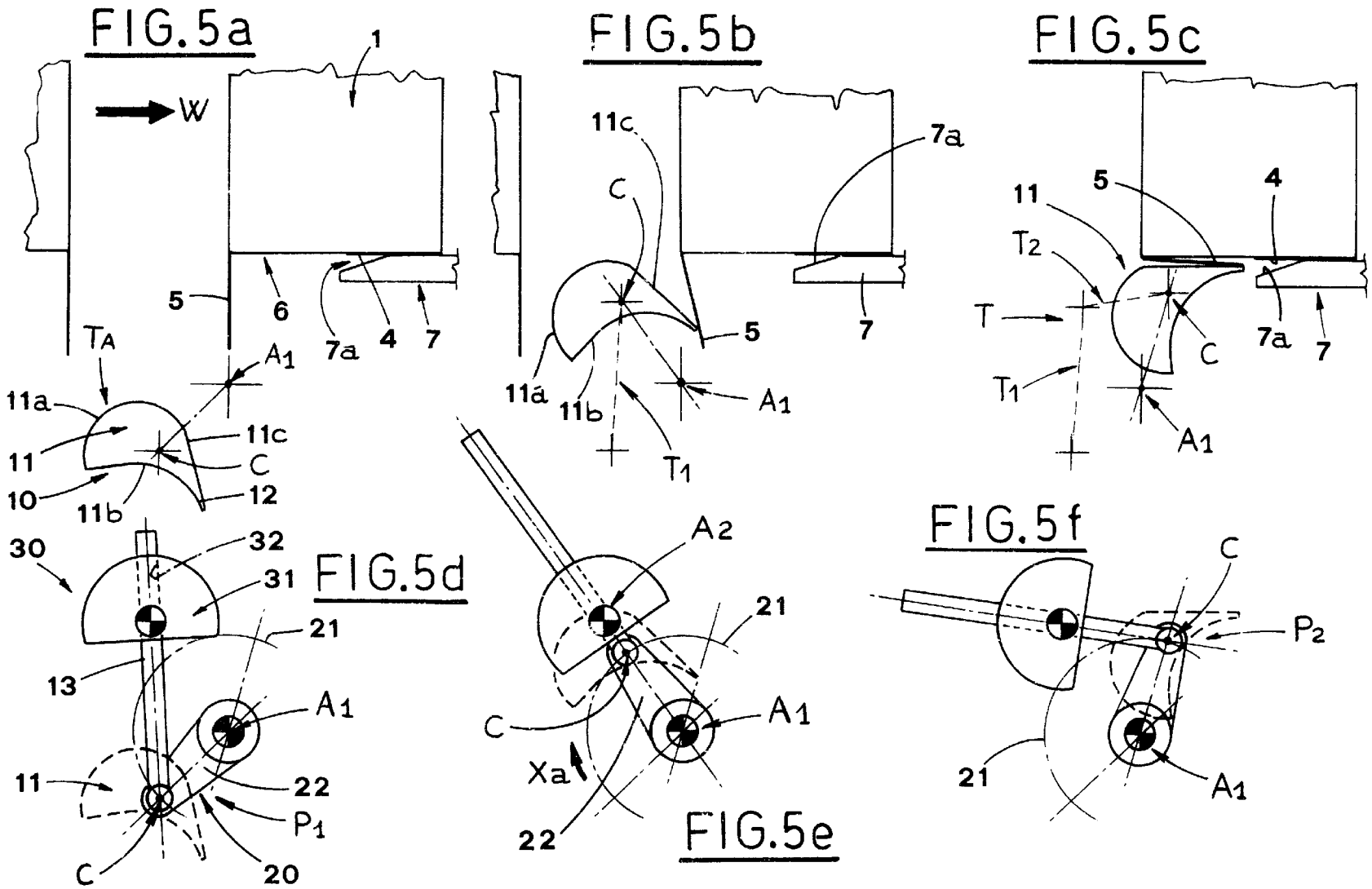
FIGS. 5*a*, 5*b* and 5*c* show schematically a preferred embodiment of the proposed device, shown in three different working steps respectively.
FIGS. 5*d*, 5*e* and 5*f* show schematically a series of views corresponding to the ones shown in FIGS. 5*a*, 5*b* and 5*c;*

The folding means 10 move cyclically along the trajectory T, which schematically includes a first part T1, along which they move close to the container 1, and a second part T2, along which they push the rear flap 5 (FIGS. 5*b*, 5*c*).

The first part T1 is approximately perpendicular to the direction W and is situated upstream of the rear flap 5, 5'.

The second part T2 is approximately parallel to the direction M and concordant therewith.

The folding means 10 include a cam-like member 11, which is situated at the level of the container 1 being transported and which is not higher than the rear vertical flap 5.

The cam-like member 11 has a convex lateral surface 11*a*, a concave surface 11*b* and a linking straight surface 11*c*, with the later two converging, so as to form a cusp 12 (FIG. 5*a*).

One end of a bar 13 is fastened to the lower surface of the cam-like member 11 in the region of a common rotation center C.

FIGS. 5*d* to 5*f* show the cam-like member 11 and the bar 13 offset with respect to cam-like member shown in FIGS. 5*a*, 5*b* and 5*c*, for obtaining a better graphic clarity.

Actually, the cam-like member 11 and the bar 13 are situated one over the other.

Supporting and operating means 20, situated under the folding means 10, are aimed at supporting the folding means 10 and at moving them along a circumference arc, substantially horizontal, concentric with a first axis A1.

The support and operating means 20 include a horizontal pulley 21 rotating about the first rotation axis A1, and a connecting rod 22.

One end of the connecting rod 22 is fastened to the pulley 21 in the region of the first rotation axis A1.

The other end of the connecting rod 22 is hinged to the same end of the bar 13, to which the cam-like member 11 is fastened.

Trajectory correcting means 30, also fastened to the bar 13, control the position of the folding means 10 while rotating about a second axis A2.

The second axis A2 is substantially parallel to the first axis A1.

The trajectory correcting means 30 include a body 31, substantially formed by a semi-cylinder, disposed horizontally and rotating freely about the second rotation axis A2.

The semi-cylinder 31 features a longitudinal hole or seat 32, substantially horizontal, which intersects the second rotation axis A2.

The seat 32 receives slidably the bar 13, so as to block and maintain it in a position, in which it is oriented toward the second rotation axis A2.

Therefore, the hinged end of the bar 13, and consequently also the cam-like member 11 are subject to another combined rotation about the second rotation axis A2 during their movement along the circumference arc concentric with the first rotation axis A1.

The combination of the above mentioned movement and rotation determines for the cusp 12 a path which advantageously pushes gently the flaps, while the cam-like member follows the trajectory T (FIG. 5*c*).

The proposed folding device includes also transmission means 80 (FIGS. 6*a*, 6*b*, 6*c*) aimed at driving the pulley 21 and the connecting rod 22, cyclically and alternately, along the circumference arc, in step relation with the operation of the packaging line 100.

The transmission means 80 include a disc 81, driven into continuous rotation by known and not shown motor means, in a rotation direction W1.

One end 82*a* of a chain 82 engaging with the pulley 21 is fastened to a joining point 81*a* made in the edge of the disc 81. The other end of the chain 82 is fastened to an end of a spring 83.

The other end of the spring 83 is fastened to a stationary support 84, situated near the disc 81.

Therefore, the chain 82 and the spring 83 assume substantially a "U" shape wound around the pulley 21.

The above described layout allows to transform the continuous rotating movement of the disc 81 into a reciprocation movement of predetermined amplitude of the chain 82 and into a partial and alternate rotation of the pulley 21.

The length of the chain 82 is such that, when the joining point 81*a* is situated at the minimum distance from the pulley 21, the spring 83 is unloaded, and when the joining point 81*a* is in the opposite position, the spring is fully tensioned.

Figures 6A, 6B, 6C:
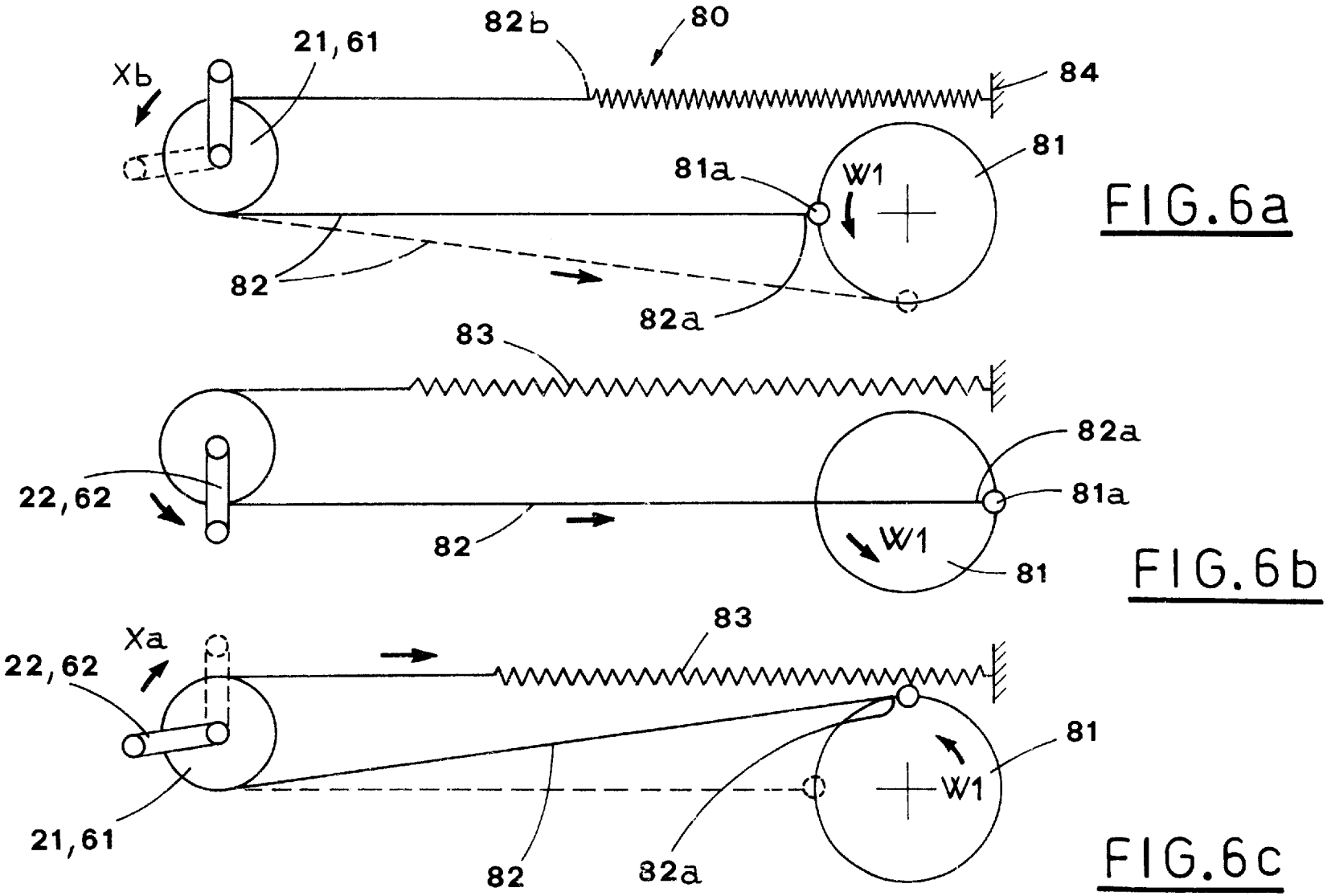
FIGS. 6*a*, 6*b* and 6*c* show schematically means for transmitting movement to the device of the FIGS. 5*a*, 5*b* and 5*c*.

Operation of the proposed device according to the first embodiment is described beginning from the configurations shown in FIGS. 5*a* and 6*b*, which show substantially synchronous steps.

In these Figures, a container 1 moves on the packaging line 100 and the fore vertical flap 4 of the container is engaged by the stationary striker 7, while the rear vertical flap 5 is still open.

The conveyor 101 usually moves stepwise and in these configurations is dwelling.

The joining point 81*a* of the disc 81 is situated at the maximum distance from the pulley 21, and consequently, the spring 83 is under tension.

The connecting rod 22 is in a first dead center P1 and the cam-like member 11 is at a point Ta of the trajectory T, which is at a maximum distance from the container 1.

The cam-like member 11 orientation is defined by the constraint made by the body 31 on the rod 13.

The cusp 12 is turned outward of the packaging line 100.

The progressive rotation of the disc 81 in the direction W1 allows the spring 83 to act elastically on the chain 82, thus making the pulley 21 rotate in a direction Xa (FIG. 6*c*).

This makes the cam-like member 11 move along the circumference arc centered on the first rotation axis A1 and rotate counterclockwise due to the bar 13 sliding in the seat 32 of the body 31 (FIG. 5*b*).

Therefore, the cam-like member 11 covers only the part T1 of the trajectory T (FIG. 5*b*), which brings it close to the container 1, upstream of the rear vertical flap 5, until the cusp 12 touches the latter.

Further rotation of the disc 81, until the joining point 81*a* reaches the position in which it is at a minimum distance from the pulley 21, allows the spring 83 to become completely released (FIG. 6*a*) and allows the pulley 21 to reach a second dead center P2 (FIG. 5*c*).

Meanwhile, the cam-like member 11 covers the part T2 of the trajectory T, which provokes a further counterclockwise rotation of the cam-like member 11 about the second rotation axis A2.

Thus, the cusp 12 engages progressively the rear vertical flap 5 with the straight surface 11*c* and folds it toward the inside of the aperture 6.

At this point, the conveyor 101 is operated so as to allow the so folded rear flap 5 to be moved forward, until it is engaged by the stationary striker 7.

The disc 81 continues to rotate and the joining point 81*a* moves far from the pulley 21 (FIG. 6*a*, indicated with broken line), thus making the pulley rotate in a direction Xb, opposite to the direction Xa, until the joining point 81*a* reaches its maximum distance from the pulley shown in FIG. 6*b*.

Meanwhile, the cam-like member 11 covers the trajectory T backwards and returns to its initial position, so as to perform another folding cycle.

It is to be pointed out that the above described layout allows to perform the folding active step due to the elastic action of the spring 83 and therefore, it is not bound to rigid mechanical transmissions.

This increases considerably the device safety and reliability, since inconveniences which can occur during folding operations do not damage the device or other elements of the system.

The device made according to the present invention is much more efficient and versatile with respect to the prior art.

The main advantage of the present invention derives from the possibility to work with a wide range of the container 1 having different sizes.

In fact, the cam-like member 11 trajectory includes a part along which the cam-like member 11 follows the rear vertical flap from upstream to downstream, which allows to intercept also the flaps arranged in a different way, without a necessity of repositioning of the cam-like member or the arm, which also avoids the packaging machine adjustments.

Another advantage of the present invention results from the rear flaps progressive folding and following action, which allows to avoid the damages to the flaps.

A further advantage of the present invention, obtained by the second embodiment, lies in the fact that the proposed folding device can be used also when the horizontal flaps are situated in the lower wall of the container, independently from the container size.

Yet further advantage of the present invention derives from the fact that the proposed device is safe and is operated in a simple and efficient way.

It is understood that what above has been described as a pure, not limiting example, therefore possible modifications or variants of the invention remain within the protective scope of the present technical solution as claimed hereinafter.

What is claimed is:

1. A Device for folding vertical flaps of containers, the containers (1) being moved in a forward direction (W) along a line (100) for packaging products (3) into the containers (1), each container (1) including at least one fore vertical flap (4) and at least one rear vertical flap (5), which are to be folded toward the inside of a corresponding aperture (6) of the container, so as to define respective head walls of the container (1);

at least one stationary striker (7) situated beside said packaging line (100) and in a path of said aperture (6), for intercepting said fore vertical flap (4) while said container is moving and for folding said fore flap (4) toward the inside of said aperture (6);

folding means (10) for folding said rear vertical flap (5), situated upstream of said stationary striker (7) with respect to said forward direction (W), said folding means (10) moving cyclically along a trajectory (T) including at least one first part (T1), in which said folding means move close to said container (1), and at least one second part (T2), in which said folding means (10) touch said rear flap (5) and fold it toward inside of said aperture (6), said first part (T1) being substantially perpendicular to said forward direction (W), upstream of said rear flap (5), and said second part (T2) being substantially parallel to said forward direction (W) and concordant therewith;

supporting and operating means (20) for supporting and guiding said folding means (10) along a circumference arc concentric with a first axis (A1);

trajectory correcting means (30) guided by said folding means (10) for constraining said folding means (10) while rotating about a second axis (A2), said second axis (A2) being substantially parallel to said first axis (A1), with a combination of a shift and rotation movements causing said folding means (10) follow said trajectory (T);

transmission means (80), aimed at moving said operating means (20) in step relation with the packaging line (100) forward movement;

the device wherein said folding means (10) include;

a cam member (11) in height shorter than, or at least equal to, said rear vertical flap (5), for intercepting said rear vertical flap (5) while following said second part of said trajectory (T);

and a substantially horizontal bar (13) with one fastened to a lower surface of said cam member (11) in the region of a common rotation center (C), and hinged to said support and operating means (20), said bar (13) being also fastened to said trajectory correcting means (30).

2. A device, according to claim 1, wherein the edge of said cam member (11) is defined by a convex surface **(11*a*), a concave surface (11*b*), and a linking straight surface (11*c*), with said concave surface (11*b*) and straight surface (11*c*) converging, so as to form a cusp (12)**.

3. A device, according to claim 1 wherein said supporting and operating means (20) include a pulley (21), rotating about said first rotation axis (A1), and a connecting rod (22) with one end fastened to said pulley (21) in the region of said first rotation axis (A1) and with another end carrying said bar (13) hinged thereto.

4. A device, according to claim 1, wherein said trajectory correcting means (30) include a body (31), rotating about said second rotation axis (A2) and featuring a longitudinal substantially horizontal seat (32) intersecting said rotation axis (A2), said seat (32) being aimed at receiving slidably said bar (13).

5. A device, according to claim 1, wherein said transmission means (80) include:

a disc (81), driven into continuous rotation in a direction (W1);

a chain (B2), whose one end **(82*a*) is linked to the edge of said disc (81) and is aimed at engaging a corresponding pulley (21) of said supporting and working means (20)**;

a spring (83), fastened to the other end **(82*b*) of said chain (82) and to a stationary support (84); said disc (81) being aimed at guiding said chain (82) in reciprocating motion of predetermined amplitude, against the elastic action of said spring (83)**.

* * * * *